US006350008B1

(12) United States Patent
Lin

(10) Patent No.: US 6,350,008 B1
(45) Date of Patent: Feb. 26, 2002

(54) INK JET STATION ASSEMBLY

(75) Inventor: Tsung-Te Lin, Sanchung (TW)

(73) Assignee: Acer Communications and Multimedia Inc., Taipei (TW)

( * ) Notice: Subject to any disclaimer, the term of this patent is extended or adjusted under 35 U.S.C. 154(b) by 0 days.

(21) Appl. No.: 09/671,267

(22) Filed: Sep. 28, 2000

(51) Int. Cl.[7] ..... B41J 2/165
(52) U.S. Cl. ..... 347/33; 347/29; 347/32
(58) Field of Search ..... 347/33, 30, 24, 347/29, 32, 23, 104; 15/250.361

(56) References Cited

U.S. PATENT DOCUMENTS 5,440,331 A * 8/1995 Grange ..... 347/32
5,793,391 A * 8/1998 Kawakami et al. ..... 347/33

FOREIGN PATENT DOCUMENTS

JP 408207293 A * 8/1996 ..... 347/33

* cited by examiner

*Primary Examiner*—N. Le
*Assistant Examiner*—Shih-wen Hsieh
(74) *Attorney, Agent, or Firm*—Winston Hsu

(57) ABSTRACT

A print head moves forward and backward along a print track to perform a printing operation, and has at least one nozzle. A station assembly includes a carrier for holding the print head, the carrier moving the print head forward and backward along the print track, and a service station for servicing the print head. The service station is located at one end of the print track and has a housing, and a wiper assembly mounted in the housing for engaging with the carrier to wipe the nozzle. The wiper assembly has a wiper to wipe the nozzle and a carrier contact for mechanically engaging and contacting with the carrier. The carrier contact slides against the carrier along a wiping direction to provide the mechanical motion of the wiper to wipe the nozzles.

20 Claims, 7 Drawing Sheets

INK JET STATION ASSEMBLY

BACKGROUND OF THE INVENTION

1. Field of the Invention

The present invention relates to an ink jet station assembly. More specifically, the present invention discloses a wiper of an ink jet service station that obtains its operating mechanical power from the movement of a carrier that holds the ink jet print head.

2. Description of the Prior Art

Ink jet printing systems are found in a variety of faxes, printers and other types of office equipment. To ensure the continuous proper operation of an ink jet print head within the ink jet printing system, the ink jet printing system has an ink jet service station. The ink jet service station performs basic head cleaning and capping functions. The ink jet nozzles of the print head are capped when the printing system is not in use. This prevents the nozzles from drying out, and thus becoming clogged. Prior to printing, and at periodic intervals during a printing session, the ink jet nozzles are wiped clean to ensure their performance. A wiper in the ink jet service station performs this wiping function.

The nozzles of the ink jet print head are preferably not wiped prior to capping because the excess ink on the nozzles helps to ensure that they remain moist. Because of this, it is necessary that the wiper of the ink jet service station move out of the way of the nozzles when the ink jet print head comes into the station to dock. Only when the print head undocks, i.e., when the nozzles are uncapped, should the wiper move into position to wipe the nozzles.

The prior art ink jet service station has a motor that is used exclusively to individually move the wiping and capping elements into their respective active positions. Although this is an effective method, it is also somewhat expensive as it requires an extra motor, as well as the control circuitry and associated torque-transfer mechanisms that mechanically connect the motor to the wiping and capping elements.

SUMMARY OF THE INVENTION

It is therefore a primary objective of this invention to provide an ink jet service station that uses the mechanical motion of the ink jet print head to move the wiper into position.

The present invention, briefly summarized, discloses an ink jet station assembly for an ink jet print head of a printing device. The print head moves forward and backward along a print track to perform a printing operation, and has at least one nozzle. The station assembly includes a carrier for holding the print head, the carrier moving the print head forward and backward along a carrier moving direction, and a service station for servicing the print head. The service station is located at one end of the print track and has a housing, and a wiper assembly mounted in the housing for engaging with the carrier to wipe the nozzle. The wiper assembly has a wiper to wipe the nozzle and a carrier contact for mechanically engaging and contacting with the carrier. The carrier has a guiding means, which is a protrusion formed on the carrier. The guiding means extends along a wiping direction that is substantially perpendicular to the carrier moving direction. The carrier contact slides against the carrier along the wiping direction to provide the mechanical motion of the wiper.

It is an advantage of the present invention that the carrier, whose job it is to move the print head back and forth to perform a printing function, engages with the carrier contact to provide the mechanical motion that moves the wiper. Thus, a second motor devoted exclusively to the ink jet service station is not required, which reduces the overall cost of the printing device.

These and other objectives of the present invention will no doubt become obvious to those of ordinary skill in the art after reading the following detailed description of the preferred embodiment, which is illustrated in the various figures and drawings.

DETAILED DESCRIPTION OF THE PREFERRED EMBODIMENT

Figure 1:
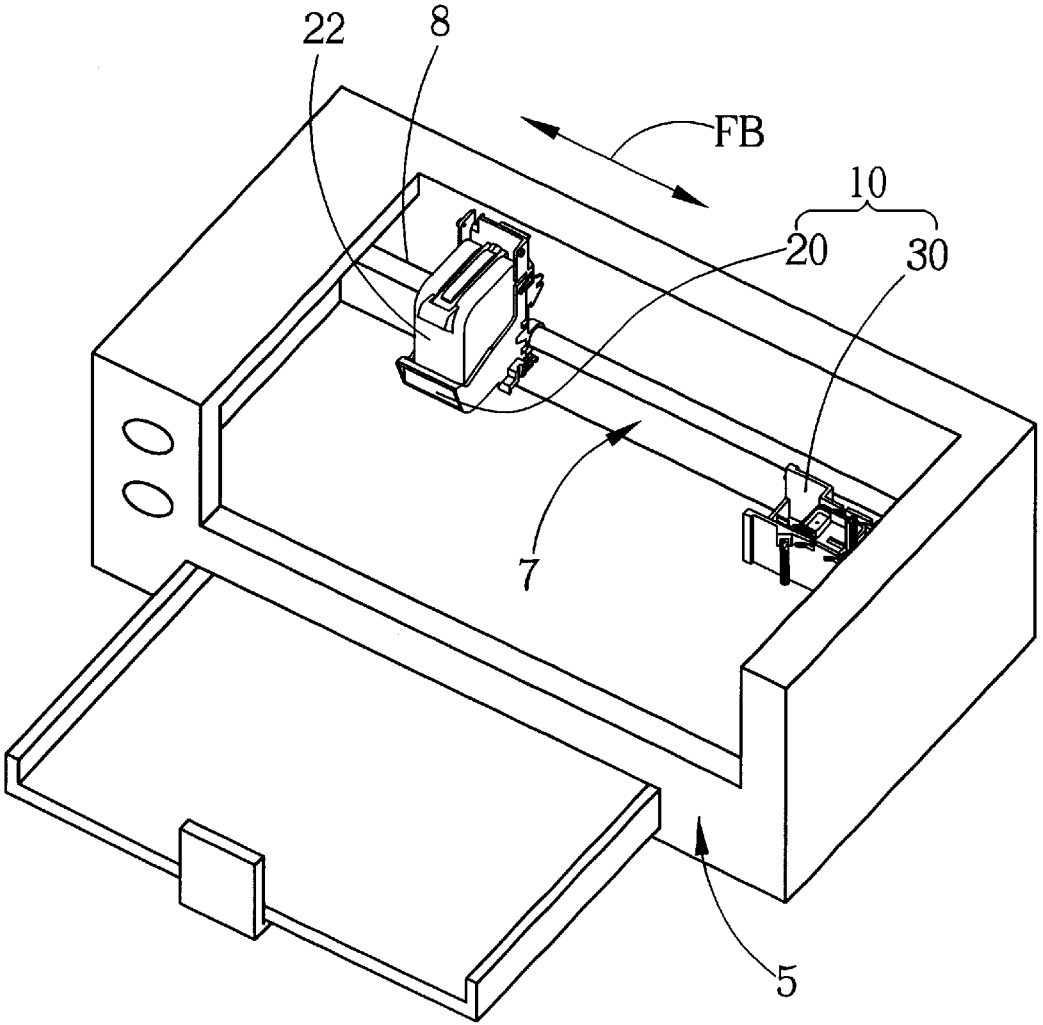
FIG. 1 is a perspective view of a preferred embodiment of an ink jet station assembly installed in a printing device.
Figure 2:
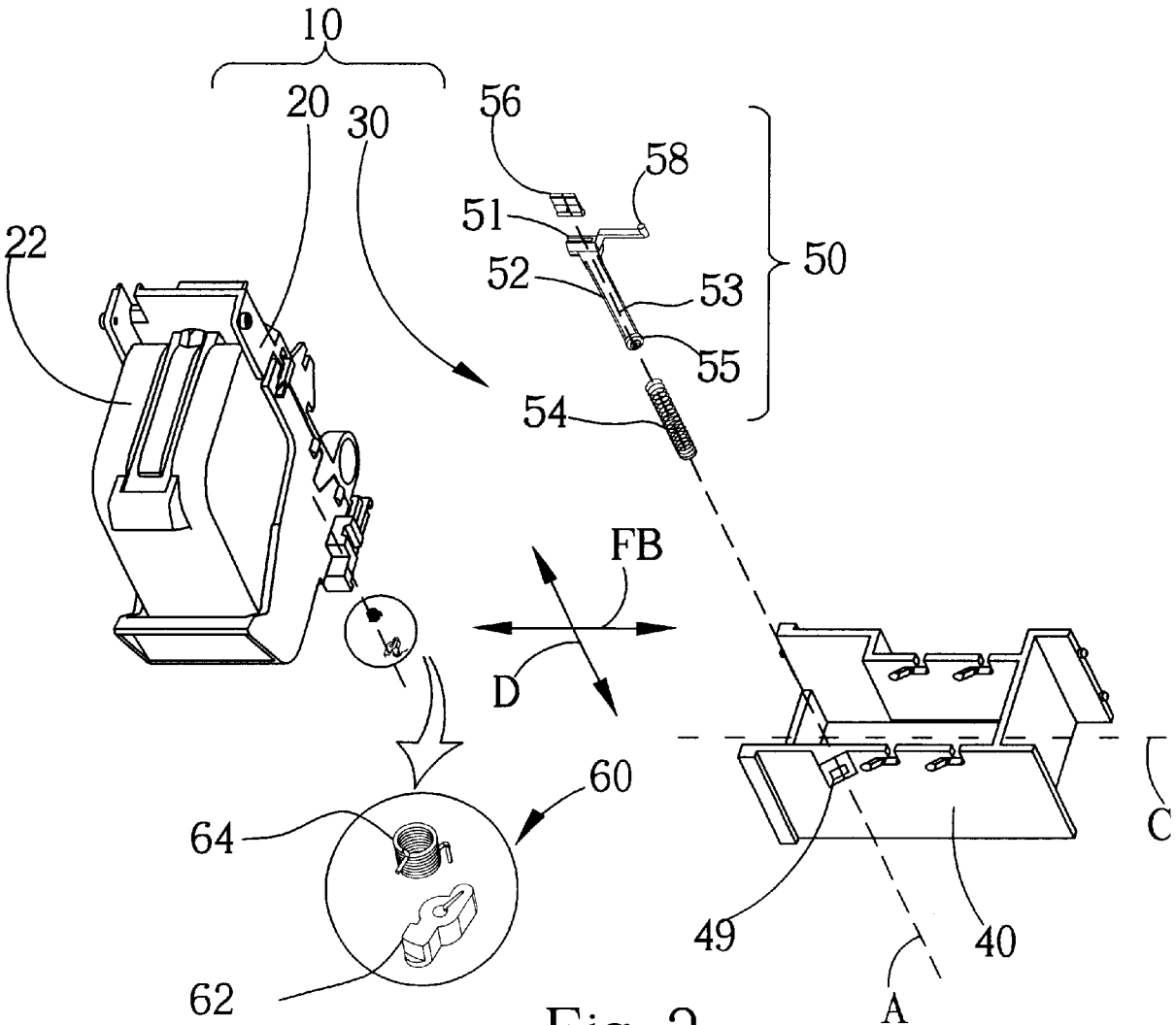
FIG. 2 is an exploded view diagram of an ink jet station assembly of the present invention.
Figure 3A:
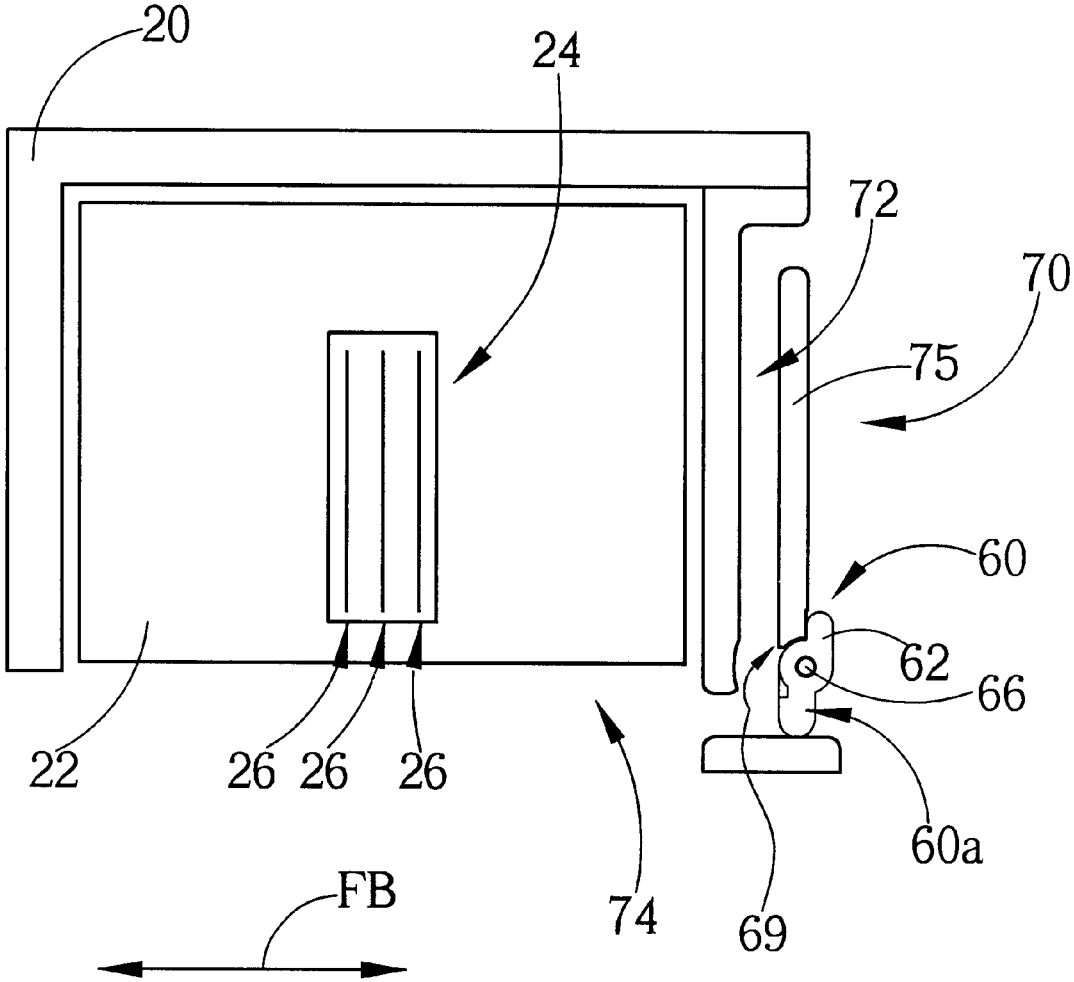
FIG. 3A is a bottom view of a carrier of the present invention holding an ink jet cartridge.
Figure 3B:
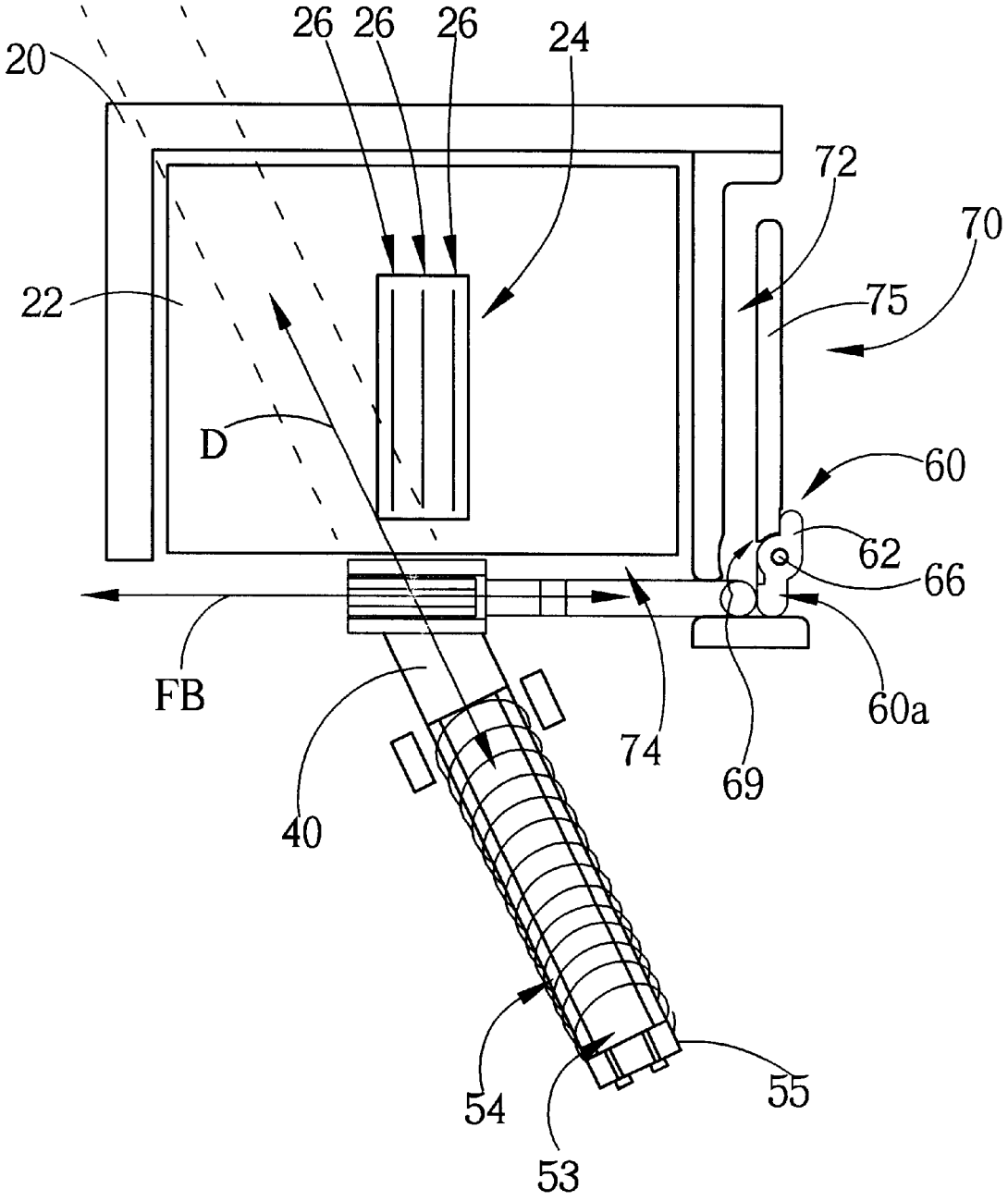
FIG. 3B is a bottom view of a carrier and wiping armature of the present invention.

Please refer to FIG. 1 to FIG. 3. FIG. 1 is a perspective view of a preferred embodiment of an ink jet station assembly 10 installed in a printing device 5. FIG. 2 is an exploded view diagram of the ink jet station assembly 10. FIG. 3 is a bottom view of a carrier 20 holding an ink jet cartridge 22. The ink jet station 10 comprises the carrier 20 and a service station 30. The carrier 20 is mechanically connected to a driving device 8 that moves the carrier 20 forward and backward along a print track 7. This forward and backward movement is indicated by arrow FB. Installed in the carrier 20 is an ink jet cartridge 22. The ink jet cartridge 22 holds the ink (not shown) required for printing, and on its underside has a print head 24 that performs the actual printing operation as the cartridge 22 is driven forward and backward by the carrier 20. The print head 24 comprises rows of nozzles 26. In color printing, for example, each row of nozzles 26 would be dedicated to one of the primary colors, i.e., cyan, magenta or yellow. It is the nozzles 26 that spray the ink to perform the printing process. The service station 30 is used to wipe the nozzles 26.

The ink jet cartridge 22 can be removed from the carrier 20 and replaced with a new ink jet cartridge 22 when it runs out of ink, or becomes damaged. The carrier 20 nevertheless, securely holds the ink jet cartridge 22. The underside of the carrier 20 comprises a guiding means, which is a protrusion formed on the carrier having an L-shaped receiving slot 70. The L-shaped receiving slot 70 has two individual receiving slots: a first receiving slot 72 that runs perpendicular to the arrow FB, and a second receiving slot 74 that runs parallel to the arrow FB. At the intersection of the first receiving slot 72 and the second receiving slot 74 is a gate 60. In FIG. 3, the gate 60 is shown in a closed position. The gate 60 can, however, be rotated into an open position when an object presses against a lower portion 60*a* of the gate 60.

As shown in FIG. 2 and FIG. 3, the gate 60 comprises a shunt 62 and an elastic element, a torsion spring 64. The shunt 62 is rotatably mounted on a pivot 66. Hence, the shunt 62 can rotate in a receiving direction indicated by arrow 69, which opens the gate 60. However, the placement of the shunt 62 in respect to a guide rail 75 of the first receiving slot 72 prevents the shunt 62 from rotating in a direction counter to the receiving direction 69 when the shunt is in the closed position. Consequently, when the gate 60 is in the open position, the shunt 62 can rotate counter to arrow 69 only as far as the closed position, and is then stopped by the guide rail 75. The torsion spring 64 is used to place a torque on the shunt 62 that tends to rotate the shunt back to the closed position, i.e., in a direction counter to that of arrow 69.

The service station 30 is located at one end of the print track 7 and is used to service the print head 24. One of these services is to provide a capping function for the print head 24 during idle periods to prevent the nozzles 26 from drying out. For viewing convenience of the diagrams, however, this service is not shown, as it is not directly relevant to the present invention.

The other service performed, and which is of relevance to the present invention, is the wiping of the nozzles 26. This wiping function for the nozzles 26 is performed by a wiper assembly 50. The wiper assembly 50 is installed in a housing 40 of the service station 30. The wiper assembly 50 comprises an armature 52, a carrier contact 58 formed on the armature 52, a spring 54, and a wiper 56. The wiper 56 is made of a flexible material, such as rubber, and is used to wipe the nozzles 26 of the print head 24. The wiper 56 is removably held in a slot 51 formed on the armature 52, and thus can be replaced if the wiper 56 becomes worn or damaged. The armature 52 has a sliding arm 53 that is slidably disposed in a guide hole 49 of the housing 40, and can thus slide back and forth along a horizontal direction indicated by the arrow D. The horizontal direction D is diagonal to the direction FB, and hence is also diagonal to the first receiving slot 72. As shown from FIG. 3B, the spring 54 is disposed around the sliding arm 53, and is restricted between an end 55 of the armature 52 and the housing 40. The compression of the spring 54 creates a force on the armature that tends to draw the wiper assembly 50 toward a home position when no external force is applied to the wiper assembly 50, i.e., to make the carrier contact. Hence, the carrier contact 58 tends to stay in a position that is to the right of the gate 60 and the second receiving slot 74. The home position is also indicated in FIG. 2 as the intersection of dotted lines A and C. Note that the dotted line A lies parallel to the direction D, whereas the dotted line C lies parallel to the direction FB.

Please refer to FIG. 4 to FIG. 9, in conjunction with FIG. 2 and FIG. 3. FIG. 4 to FIG. 9 are bottom views of the wiper assembly 50 engaging with the carrier 20 so that the wiper 56 will wipe the nozzles 26. In FIG. 4 to FIG. 9, the dotted line H represents the position of the carrier contact 58 when the spring 54 is not compressed due to a force pulling on the armature 52. That is, the dotted line H shows the position of the carrier contact 58 when the wiper 56 is in the home position, and thus directly corresponds to the home position of the wiper 56. It should be understood that the home position of the wiper is a fixed location relative to the housing 40, and hence does not move. Consequently, the dotted line H also represents a fixed position relative to the housing 40. The dotted line H may appear to shift position from figure to figure in the diagrams, but this is simply an artifact imposed by space limitations.

Figure 4:
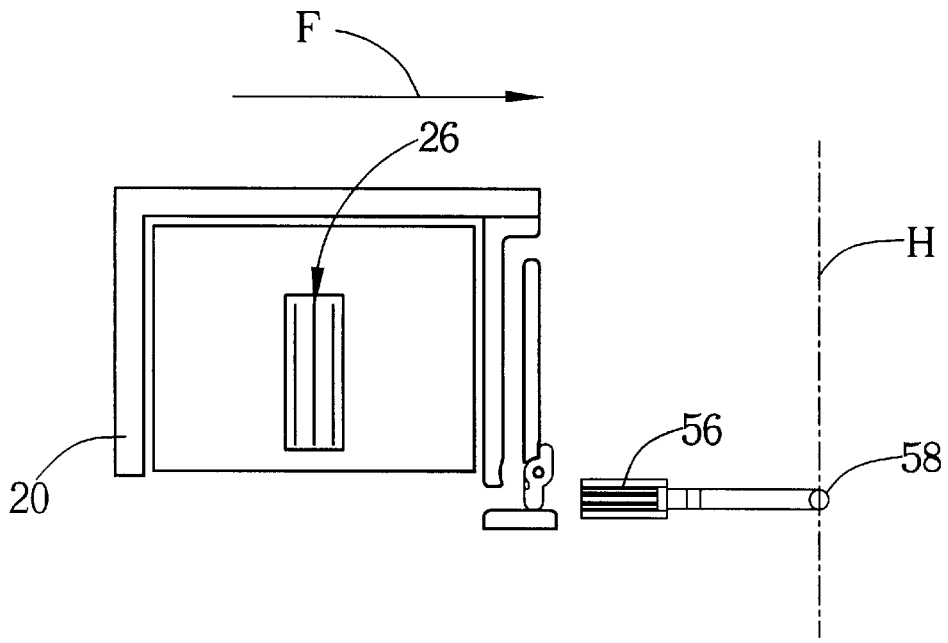
FIG. 4 to FIG. 9 are bottom views of a wiper assembly of the present invention engaging with a carrier of the present invention so that a wiper will perform a wiping operation.

In FIG. 4, the carrier 20 initially moves in a forward direction, indicated by arrow F, to move into the service station 30. The arrow F is simply the forward component of the direction FB of FIG. 2. Because the carrier 20 is moving toward the service station 30 to dock for an uncertain period of time, the nozzles 26 do not need to be wiped by the wiper 56. Before coming into contact with the carrier 20, the wiper assembly 50 is at rest in its home position, as indicated by the carrier contact 58 lying on the line H.

Figure 5:
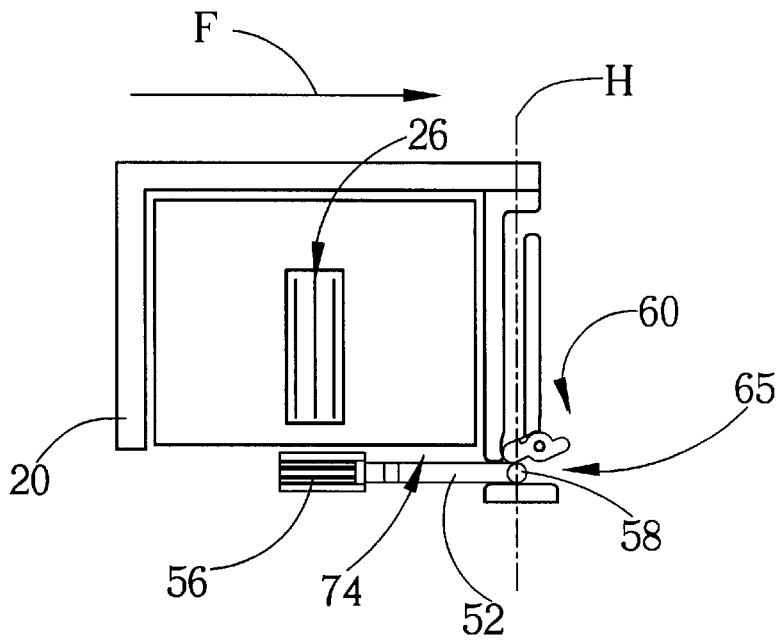

In FIG. 5, the carrier 20, moving further in the direction F, reaches an entrance 65 of the carrier 20. The entrance is at the location where the carrier contact 58 contacts the gate 60 of the carrier 20. The carrier contact 58 protrudes up above the housing 40 sufficiently to engage with the carrier 20. Initially, as the carrier contact 58 is in its home position H, it strikes the gate 60, placing a torque upon the gate 60 which causes the shunt 62 to turn in the receiving direction 69, opening the gate 60. As the carrier 20 continues to move forward along the direction F, the carrier contact 58 will pass through the gate 60 to enter the second receiving slot 74, and then the shunt 62 will snap to the closed position behind the carrier contact 58. In this manner, the carrier contact 58 moves along the carrier 20 along the second receiving slot 74. As the second receiving slot 74 extends along the direction of movement of F, no external force is applied to the carrier contact 58 to draw the wiper 56 out of the home position. Also note that, as the wiper 56 is not moved from its home position at this time, and as the home position of the wiper 56 is off to one side from the nozzles 26, the wiper 56 does not wipe the nozzles 26.

Figure 6:
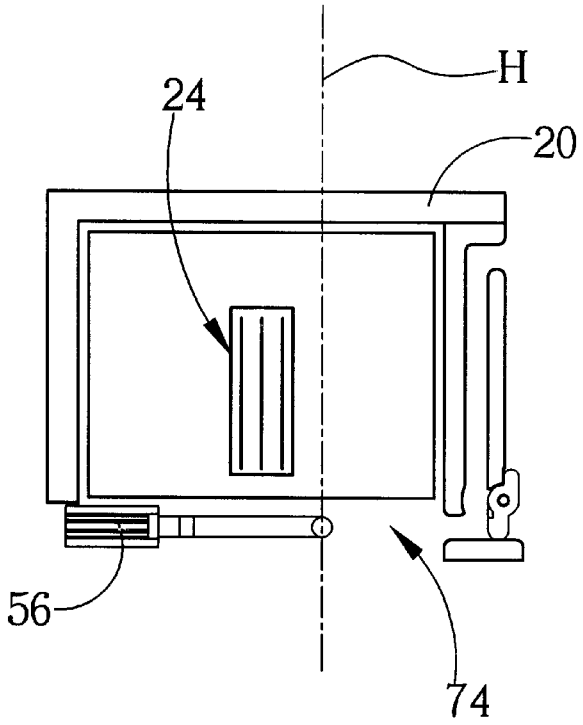

In FIG. 6, the carrier 20 has come to a rest position in the service station 30 so that the print head 24 may be capped. In this position, the carrier contact 58 lies in the second receiving slot 74, and is still in its home position H. The wiper 56 is thus also in its home position.

Figure 7:
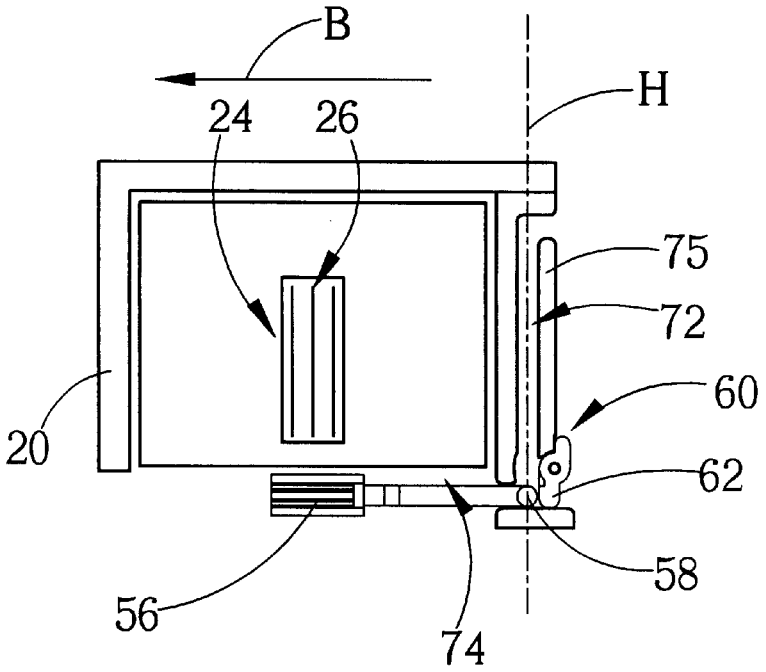

In FIG. 7 the carrier is moving in a backwards direction, indicated by arrow B, to back out of the service station 30. As a printing operation is to be performed, the wiper 56 should now wipe the nozzles 26 of the print head 24. As the carrier 20 moves backwards along the arrow B, the carrier contact 58 strikes the gate 60. This creates a counterclockwise torque that is counter the receiving direction 69 that opens the gate 60. As explained above, the gate 60, when in the closed position, cannot be rotated counter to the direction 69. Consequently, the carrier contact 58 is not able to get out of the carrier 20. Instead, the closed gate 60 forces the carrier contact 58 to move along the first receiving slot 72. In effect, the carrier 20 uses the shunt 62 and the guide rail 75 to pull on the armature 52 by way of the carrier contact 58.

Figure 8:
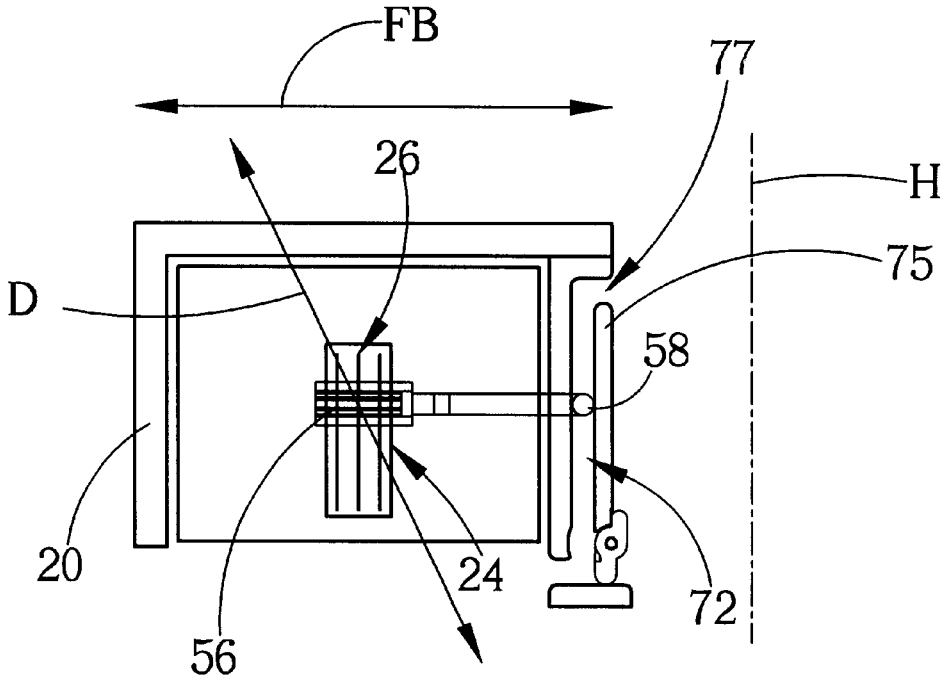

As shown in FIG. 8, as the armature 52 is pulled in the direction D, which is diagonal to both the direction FB and the first receiving slot 72, the carrier contact 58 moves along the first receiving slot 72. Pulling on the armature 52, by way of the guide rail 75 pulling on the carrier contact 58, causes the wiper 56 to leave its home position. This is indicated in FIG. 8, as the carrier contact 58 also leaves its home position H. In doing so, the wiper 56 moves towards the center of the housing 40 and wipes the nozzles 26 of the print head 24. It is the overall diagonal motion of the wiper 56 that allows it to move across the print head 24 as the carrier 20 moves out of the service station 30. This diagonal motion, in turn, is created by the carrier contact 58 sliding against the carrier 20 along the first receiving slot 72. In fact, if several wiping motions are necessary for cleaning the nozzle 24 completely, the carrier 20 can move forward and backward for a short distance to keep the carrier contact 58 sliding back and forth within the first receiving slot 72. As the carrier 20 moves backwards, the wiper 56 moves up and the carrier contact 58 moves towards an exit 77. As the carrier 20 moves forward, the wiper 56 moves down and the carrier contact 58 moves towards its home position H.

Figure 9:
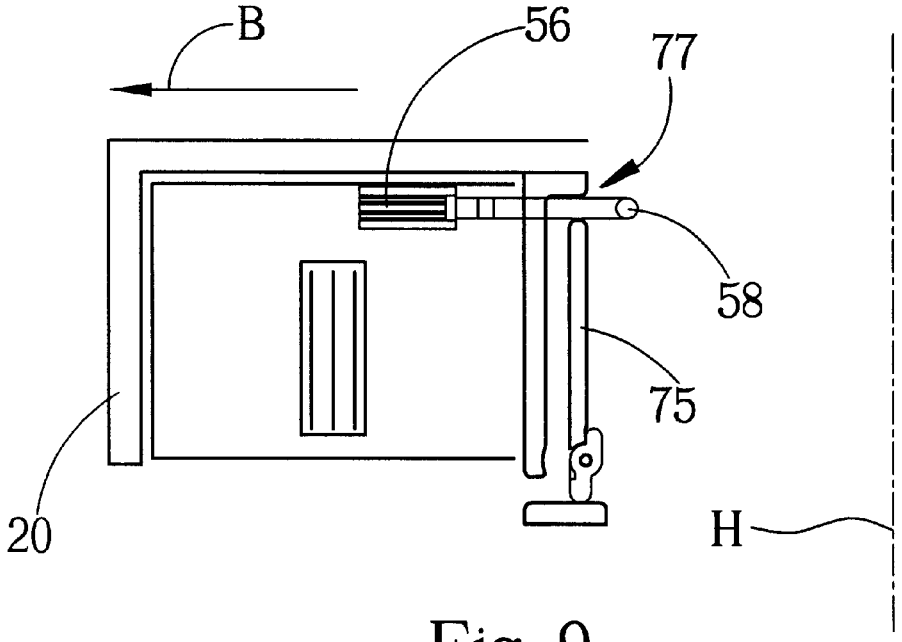

Finally, as shown in FIG. 9, the carrier 20 continues to move along the direction B, backing fully out of the service station 30. In doing so, it crosses the exit 77. When the carrier contact 58 reaches the exit 77, the guide rail 75 can no longer pull on the carrier contact 58. Hence, the spring 54 is free to retract the armature 52, which thus pulls the carrier contact 58 back to its home position H, and the wiper 56 back to its home position. This resets the wiper assembly 50 back to the original configuration shown in FIG. 4.

In contrast to the prior art, the wiper assembly of the present invention, in conjunction with an L-shaped receiving slot 70 and a gate 60 on the carrier, uses the motion of the carrier to provide the mechanical force needed to get the wiper to wipe the print head. Hence, a separate motor is not needed to drive the wiping assembly of the present invention. As the carrier backs out of the service station, the carrier pulls upon a diagonally disposed armature. This causes the armature to extend into the service station, and in extending a wiper on the armature wipes the nozzles of the print head.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An ink jet station assembly for an ink jet print head of a printing device, the print head moving forward and backward along a print track to perform a printing operation, the print head comprising a nozzle, the ink jet station assembly comprising:

a carrier for holding the print head, the carrier moving the print head forward and backward along the print track; and a service station located at one end of the print track, the service station comprising:

a housing; and a wiper assembly installed in the housing being capable of engaging with the carrier to wipe the nozzle, the wiper assembly comprising a wiper to wipe the nozzle and a carrier contact for mechanically engaging and contacting with the carrier;

wherein the carrier contact is driven by the carrier to slide along a wiping direction against the carrier to provide the mechanical motion of the wiper.

2. The ink jet station assembly of claim 1 wherein the wiping direction is predominantly perpendicular to the print track.

3. The ink jet station assembly of claim 1 wherein when the carrier moves forward into the service station and contacts the carrier contact, the carrier contact slides along a carrier moving direction in the carrier, and when the carrier moves backwards out of the service station the carrier contact moves along the wiping direction to wipe the nozzle.

4. The ink jet station assembly of claim 3 wherein the carrier moving direction is predominantly parallel to the print track.

5. The ink jet station assembly of claim 3 wherein the wiper has a home position, and as the carrier contact moves forward along the wiping direction against the carrier, the wiper moves out of the home position to wipe the nozzle.

6. The ink jet station assembly of claim 5 wherein when the carrier moves backwards out of the service station and passes an exit, the wiper returns to the home position.

7. The ink jet station assembly of claim 6 wherein the carrier comprises a first receiving slot along the wiping direction, and a second receiving slot along the carrier moving direction; wherein when the carrier moves forward into the service station and passes an entrance, the carrier contact moves along the second receiving slot, and when the carrier moves backwards out of the service station the carrier contact moves along the first receiving slot.

8. The ink jet station assembly of claim 7 wherein the first receiving slot and the second receiving slot together form an approximately L-shaped receiving slot.

9. The ink jet station assembly of claim 8 wherein the carrier further comprises a gate located at the junction of the first receiving slot and the second receiving slot; wherein the gate permits the carrier contact to move forward into the second receiving slot when the carrier moves forward past the entrance, and prevents the carrier contact from exiting the L-shaped receiving slot until the carrier passes the exit, thus forcing the carrier contact to move along the first receiving slot so that the wiper will wipe the nozzle.

10. The ink jet station assembly of claim 9 wherein the gate comprises a shunt rotatably mounted at the junction, and an elastic element for returning the shunt to a closed position; wherein when the carrier moves forward past the entrance, the carrier contact pushes against the shunt, causing the shunt to rotate in a receiving direction to an open position that permits the carrier contact to move along into the second receiving slot, and when the carrier contact passes the shunt, the elastic element returns the shunt to the closed position.

11. The ink jet station assembly of claim 10 wherein when the carrier contact is in the second receiving slot, the shunt is in the closed position, and the carrier contact contacts the shunt, the carrier contact cannot rotate the shunt in a direction counter to the receiving direction to open the shunt, and the shunt thus forces the carrier contact to move along the first receiving slot.

12. The ink jet station assembly of claim 1 wherein the wiper assembly further comprises an armature and an elastic element, and the wiper, the carrier contact and the elastic element are mounted on the armature; wherein the armature is slidably mounted on the housing along a direction diagonal to the wiping direction, and the elastic element causes the armature to return the wiper to a home position.

13. The ink jet station assembly of claim 12 wherein as the carrier contact moves against the carrier along the wiping direction, the armature is correspondingly slid along the direction diagonal to the wiping direction.

14. An ink jet station assembly for an ink jet print head of a printing device, the print head comprising a nozzle, the ink jet station assembly comprising:

a carrier for holding the print head, the carrier disposed on a print track for moving the print head back and forth along a carrier moving direction, the carrier having a guiding means formed on the carrier, the guiding means being extended along a wiping direction; and a service station located beside the print track for receiving the carrier, the service station comprising:

a housing fixed within the printing device; and a wiper assembly slidably received within the housing, the wiper assembly comprising a wiper positioned to wipe the nozzle, and a carrier contact positioned for engaging with the guiding means;

wherein when the print head is driven by the carrier to move out of the service station, the guiding means pushes the carrier contact to make the wiper assembly move along the wiping direction to wipe the nozzle.

15. The ink jet station assembly of claim 14 wherein the guiding means is a protrusion formed on the carrier, and the carrier contact is sliding against the protrusion.

16. The ink jet station assembly of claim 14 wherein the guiding means is a first receiving slot formed on the carrier, and the carrier contact is received within the first receiving slot.

17. The ink jet station assembly of claim 16 wherein the first receiving slot has an entrance and an exit, and when the print head is moving out of the service station, the carrier contact (1) first slides within the first receiving slot from the entrance toward the exit, and (2) later escapes from the first receiving slot from the exit to make the carrier contact disengage from the first receiving slot.

18. The ink jet station assembly of claim 17 wherein the carrier has a gate disposed close to the entrance, the gate being able to rotate only in a receiving direction to prevent the carrier contact escaping from the first receiving slot from the entrance.

19. The ink jet station assembly of claim 17 wherein the wiper assembly further comprises an elastic element disposed between the carrier and the wiper assembly, the elastic element making the carrier contact stay at a home position when the carrier contact disengages from the first receiving slot, the home position corresponding to the entrance of the first receiving slot whereby the carrier contact can enter the first receiving slot smoothly when the carrier contact stays at the home position.

20. The ink jet station assembly of claim 14 wherein the wiping direction is substantially perpendicular to the carrier moving direction.

* * * * *